US005558134A

United States Patent [19]

Miyazaki

[11] Patent Number: 5,558,134

[45] Date of Patent: Sep. 24, 1996

[54] BINDING WIRE GUIDE MECHANISM FOR A BINDING MACHINE

[75] Inventor: Atsushi Miyazaki, Tokyo, Japan

[73] Assignee: Max Co., Ltd., Japan

[21] Appl. No.: 337,027

[22] Filed: Nov. 7, 1994

[30] Foreign Application Priority Data

Nov. 8, 1993 [JP] Japan ..... 5-302284

[51] Int. Cl.[6] ..... B21F 15/04

[52] U.S. Cl. ..... 140/57; 140/119

[58] Field of Search ..... 140/53, 54, 57, 140/93 A, 118, 119, 93.6

[56] References Cited

U.S. PATENT DOCUMENTS 3,590,885 7/1971 Ward ..... 140/93.6

FOREIGN PATENT DOCUMENTS 554050 4/1977 U.S.S.R. ..... 140/57

*Primary Examiner*—Lowell A. Larson

*Attorney, Agent, or Firm*—Cushman Darby & Cushman, LLP

[57] ABSTRACT

A binding wire guide mechanism in a binding machine has a bend guide member which is provided at the outlet of a straight guide member. The bend guide member has a wire receiving surface which receives a wire fed through the straight guide member in such a manner that the wire abuts obliquely against the surface. The angle of abutment of the wire with respect to the wire receiving surface is made adjustable. As the front end portion of the wire is bent while abutting against the wire receiving surface, the remaining portion of the wire is also bent; that is, the wire is continuously bent, thus forming a wire loop. The bend guide member is short, providing a free space at the front. Therefore, the wire can be positively wound around the articles with ease, which contributes to an improvement of the operating performance of the binding machine.

6 Claims, 5 Drawing Sheets

BINDING WIRE GUIDE MECHANISM FOR A BINDING MACHINE

BACKGROUND OF THE INVENTION

1. Field of Invention

This invention relates to a binding machine for binding bar-shaped materials such as iron reinforcing rods with a binding wire of metal.

2. Description of Prior Art

A binding machine of this type has been disclosed by Examined Japanese Patent Publication No. Sho. 59-39027 or Unexamined Japanese Utility Patent Publication No. Hei. 4-40686. The binding machine is designed as follows: A binding wire of metal is fed out of a binding machine body by a wire feeding mechanism while being curved, so that it is looped around articles such as bar-shaped materials to be bound, to bind them together. At the end of the binding machine body, a bend guide member is provided which is curved substantially semi-circularly to curve the wire while receiving it from the binding machine body. Hence, the wire fed out of the binding machine body is looped around the articles set inside the bend guide member while being curved along the bend guide member; that is, a wire loop is formed around the articles. A part of the wire loops thus formed is twisted with a twisting hook, so that the wire loop is forcibly decreased in diameter to bind the articles together.

In the binding operation, it is necessary to set the articles inside the bend guide member as was described above. However, to do so is rather troublesome, because of the structure of the bend guide member. That is, the bend guide member is curved substantially semi-circularly as was described above, thus obstructing the movement of articles at the front. Hence, in setting the articles inside the bend guide member, they are liable to strike the end portion of the bend guide member, thus impeding the binding operation.

On the other hand, it is necessary to change the diameter of the wire loop depending on the total diameter of articles to be bound. As the diameter of the wire loop changes, the position where the twisting hook holds the wire loop is shifted (hereinafter referred to as "a loop holding position", when applicable). Moving the twisting hook to a plurality of loop holding positions to hold the wire loops different in diameter makes the binding machine intricate in structure, and increases the weight of the latter. Thus, the movement of the twisting hook to the plurality of loop holding position is not practical. Hence, in practice, a relatively large wire loop is formed for all of the total diameters of articles, and the number of twists of the wire loop is adjusted according to the total diameter of the given articles. That is, in the case where the articles to be bound is large in total diameter, the number of twists is decreased; that is, the twisted part of the wire loop is decreased in length; whereas in the case where the articles to be bound is small in total diameter, the number of twists is increased; that is, the twisted part of the wire loop is increased in length. However, the adjustment of the number of twists in the above-described manner is disadvantageous in that, especially in binding articles small in total diameter, the wire and the wire twisting energy are not economically used. That is, the adjustment is low in efficiency.

SUMMARY OF THE INVENTION

A first object of the invention is to provide a binding wire guide mechanism for a binding machine which is free from the above-described difficulties accompanying a conventional binding wire guide mechanism, and simple in structure, and in which a binding wire of metal fed straightly is guided in such a manner that the wire is looped to form a wire loop, and the diameter of the wire loop thus formed is adjusted according to the total diameter of articles to be bound together.

A second object of the invention is to provide a binding wire guide mechanism which is able to adjust the diameter of a wire loop for binding articles together, in which at one and the same position a twisting hook is able to hold any one of the wire loops different in diameter.

A third object of the invention is to provide a binding wire guide mechanism for a binding machine which is able to adjust the amount of feed of the wire according to the diameter of the wire loop.

The first object of the invention has been achieved by the provision of a bind guide mechanism for a binding machine in which a wire of metal is looped around articles to be bound with the wire and in which a part of the wire thus looped is twisted to bind the articles together, the binding wire guide mechanism comprising: a wire feeding mechanism for feeding the wire; a straight guide member for straightly guiding the wire fed by the wire feeding mechanism; a bend guide member provided at the outlet of the straight guide member, the bend guide member having a wire receiving surface to receive the wire fed out of the straight guide member in such a manner that the wire abuts obliquely against the wire receiving surface; and an angle varying means for varying an angle of abutment which the wire forms with the wire receiving surface.

In order to achieve the second object of the invention, preferably the positions of the straight guide member and the bend guide member are adjustable according to the angle of abutment of the wire with respect to the wire receiving surface.

In order to achieve the third object of the invention, it is preferable that the amount of feed of the wire is adjustable according to the angle of inclination of the bend guide member.

The binding wire guide mechanism of the invention operates as follows: As the binding wire is fed through the straight guide member by the wire feeding mechanism, the front end portion of the binding wire is bent being abutted against the wire receiving surface of the bend guide member. The front end portion thus bent is not restored. Hence, the remaining portion of the wire, following the front end portion thus bent, is also bent; that is, the wire is continuously bent by the wire receiving surface. In this wire bending operation, the wire bending angle is maintained unchanged being regulated by the wire receiving surface. As a result, the wire thus fed is circularly curved to form a circular loop. Thus, with the binding wire guide mechanism, the wire is looped around the articles such as iron reinforcing rods, to bind them together. In the guide mechanism, the bend guide member is relatively small in length; however, the guide mechanism is able to form the same wire loop as the conventional one. Furthermore, the bend guide member, being short as was described above, provides a free space at the front. Hence, the wire can be positively wound around the articles with ease, which contributes to an improvement of the operating performance of the binding machine.

In the binding wire guide mechanism of the invention, the positions of said straight guide member and said bend guide member are adjustable according to the angle of abutment of the wire with respect to the wire receiving surface, which allows the twisting hook to be at one and the same position to twist wire loops different in diameter. Hence, the twisting hook is able to positively hold the wire loop.

In the binding wire guide mechanism of the invention, since the diameter of a wire loop to be formed with the wire is determined from the angle of inclination of the bend guide member, the amount of feed of the wire is adjusted according to the angle of inclination of the bend guide member, so that it is adjusted according to the diameter of the wire loop. This feature results in an economical and efficient use of the wire, and eliminates the difficulty that the twisted part of the wire loop is excessively long, thus resulting in the effective use of the wire twisting energy.

DETAILED DESCRIPTION OF THE PREFERRED EMBODIMENTS

Figure 1:
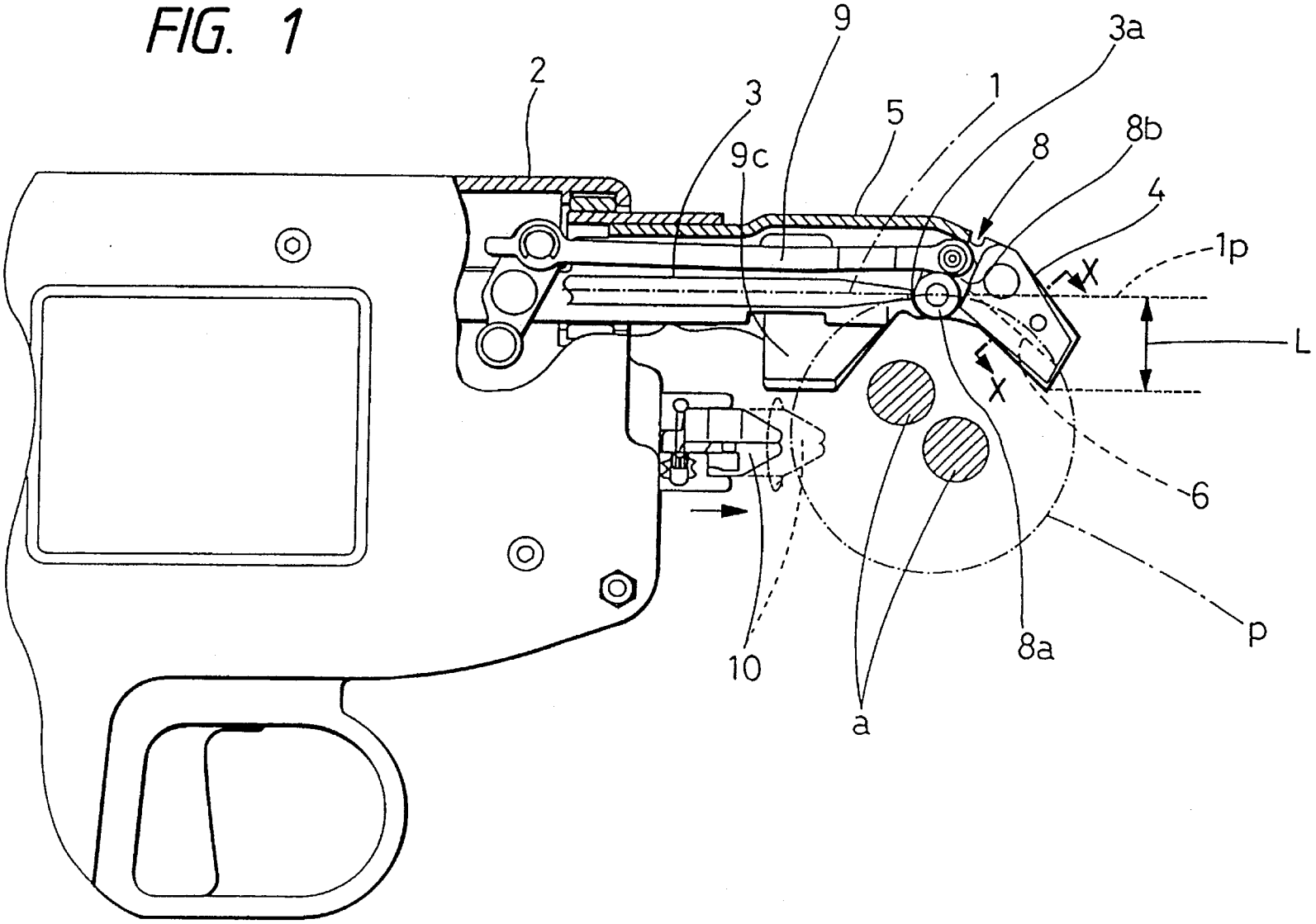
FIG. 1 is a side view outlining of a binding wire guide mechanism in a binding machine according to the invention.

FIG. 1 shows essential components of a binding wire guide mechanism in a binding machine. With the binding machine, a binding wire 1 of metal such as iron fed out of the a binding machine body 2 by a wire feeding mechanism is looped around articles a to be bound with it, and then a part of the resultant wire loop is twisted to bind the articles a together. The binding wire guide mechanism comprises a straight guide member 3, and a bend guide member 4 provided at the outlet 3*a* of the former 3.

The straight guide member 3 is to straightly guide the wire 1 fed out of the binding machine body by the wire feeding mechanism. The straight guide member 3 is in the form of a cylinder having a wire passageway along the central axis, and is supported by an arm 5 which is protruded forwardly from the winding machine body 2.

Figure 2:
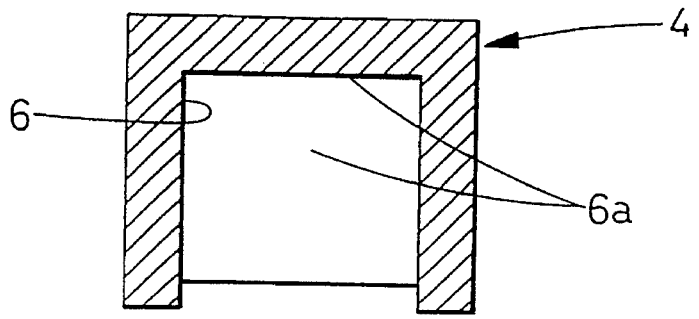
FIG. 2 is a sectional view taken along line X—X in FIG. 1.

The bend guide member 4 is to guide the binding wire 1 so that the wire 1 is circularly bent. The bend guide member 4 has a wire receiving groove 6 which is confronted with the outlet 3*a* of the straight guide member 3 to receive the binding wire 1 fed through the latter 3. As shown in FIG. 2, the bottom of the wire receiving groove 6 is formed into a wire receiving surface 6*a* which is adapted to receive the binding wire 1 in such a manner that the wire 1 obliquely meets the surface 6*a*. The wire receiving surface 6*a* may be either a flat surface or a curved surface.

The bend guide member 4 is rotatably supported on a supporting shaft 7 which is provided at the end of the binding machine body 2. The length of the bend guide member 4 is so determined that the distance L between the prolongation 1*p* of the binding wire 1 fed straightly and the end of the bend guide member 4 is slightly smaller than the radius of a wire loop p which is made circular as described later.

Figure 3:
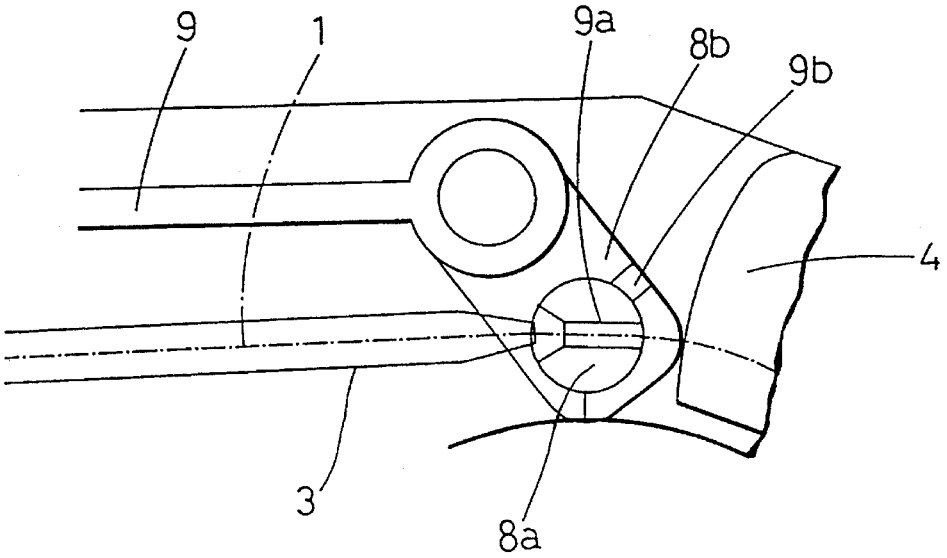
FIG. 3 is an explanatory diagram showing a wire cutting mechanism.

A cutter 8 is provided between the outlet 3*a* of the straight guide member 3 and the inlet of the bend guide member 4. The cutter 8 is designed as shown in FIGS. 1 and 3. That is, the cutter 8 comprises: a disk 8*a* having a wire passageway 9*a* which is extended diametrically (to meet the straight guide member 3); and a rotatable cutter link 8*b* which is arranged circumferentially of the disk 8*a*. The cutter link 8*b* also has a wire passageway 9*b*. The wire 1 is cut with the cutter as follows: When the cutter link 8*b* is turned by a drive link 9, the wire passageway 9*b* of the cutter line 8*b* is shifted as shown in FIG. 3, so that the wire 1 in the disk 8*a* is cut by shearing force.

In FIG. 1, reference character 9*c* designates a wire leading guide which functions as follows: After the wire 1 has been looped around the articles, the end of the wire is led again to the wire receiving groove 6 of the bend guide member 4 with the aid of the wire leading guide 9*c*.

Figure 4:
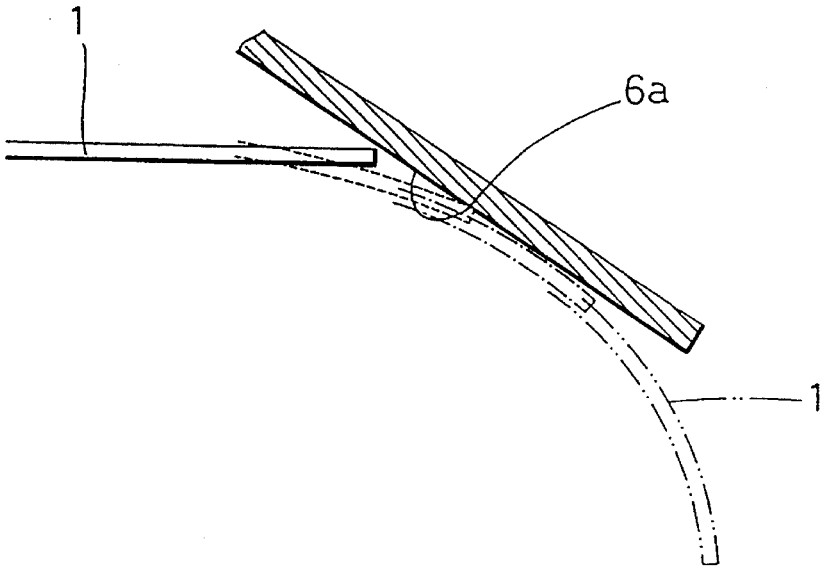
FIG. 4 is an explanatory diagram for a description of the formation of a wire loop.

The binding machine thus organized operates as follows: As the binding wire 1 is fed through the straight guide member 3 by the wire feeding mechanism, its end portion, as shown in FIG. 4, is bent being abutted against the wire receiving surface 6*a* of the bend guide member 4. The end portion thus bent is not restored. Hence, the remaining portion of the wire 1, following the end portion thus bent, is also bent; that is, the wire 1 is continuously bent by the wire receiving surface 6*a*. In this wire bending operation, the wire bending angle is maintained unchanged being regulated by the wire receiving surface 6*a*. As a result, the wire 1 thus fed is circularly curved to form a circular loop. After the wire is looped while being curved in the above-described manner, its end is led to the wire receiving groove 6 of the bend guide member 4 again by the wire leading guide 9*c*, as a result of which the formation of one circular loop of the wire, namely, one wire loop is accomplished. Articles a such as iron reinforcing rods are set beside the wire 1 so that the wire 1 is looped around them. When the wire is wound around the articles a about three turns, the feeding of the wire is suspended, and the cutter 8 is operated to cut the wire 1, and at the same time a twisting hook 10 is moved forwardly to hold the wire loop from both sides. Under this condition, the twisting hook 10 is turned to twist the wire loop to decrease the diameter of the wire loop, to bind the articles a together, to form a bundle of articles a. Thereafter, the twisting hook 10 is returned to the original position. Thus, the binding operation has been accomplished.

In the guide mechanism, the bend guide member 4 is relatively small in length; however, the binding machine is able to form the same wire loop p as the conventional one. Since the bend guide member 4 is short, providing a free space at the front, the wire 1 can be positively wound around the articles a with ease, which contributes to an improvement of the operating performance of the binding machine.

The total diameter of articles a to be bound with the wire is not always constant. Therefore, it is necessary to change the diameter of the wire loop according to the total diameter of articles. This requirement can be met by adjusting the angle of the bend guide member 4 by using suitable means as described later. The angle of the bending guide member is inversely proportion to the diameter of the wire loop; in other words, as the angle of the bend guide member is increased, the diameter of the wire loop is decreased; and as the angle is decreased, the diameter of is increased.

Figure 5:
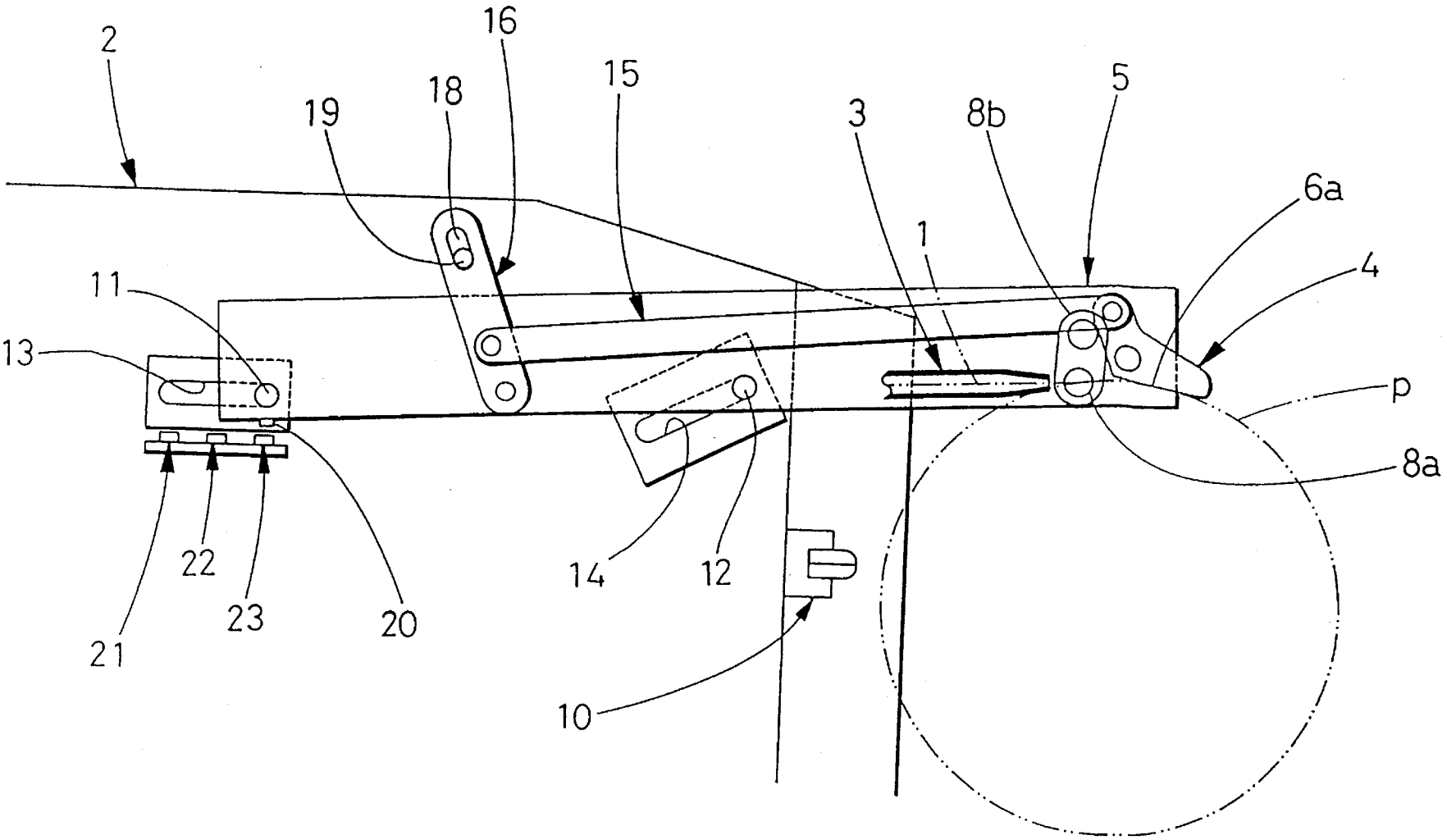
FIG. 5 is an explanatory diagram showing a position adjusting mechanism for a straight guide member and a bend guide member in the guide mechanism.

On the other hand, in order to hold the wire loop p at one and the same position independently of the diameter of the wire loop, as shown in FIG. 5 the positions of the straight guide member 3 and the bend guide member 4 are made adjustable according to the angle of abutment which the wire 1 forms with the wire receiving surface of the bend guide member 4. More specifically, as shown in FIG. 5, a first shaft 11 and a second shaft 12 are provided at the base end and at the middle of the arm 5, respectively, which supports the straight guide member. The first shaft 11 thus provided is engaged with a horizontal guide groove 13 formed horizontal in the binding machine body 2, while the second shaft 12 is engaged with an oblique guide groove 14 formed oblique in the binding machine body 2. The arm 5 is provided with a coupling link 15. One end of the coupling link 15 is coupled to an end portion of the bend guide member which is opposite to the portion where the wire receiving surface 6*a* is formed, and the other end is coupled to the middle of an operating link 16. One end of the operating link 16 is coupled to a shaft 17 embedded in the arm 5, while the other end has an elongated hole 18 which is engaged with a shaft 19 embedded in the binding machine body 2.

As the first shaft 11 of the arm 5 is moved along the horizontal guide groove 13, the bend guide member 4 at the end of the arm 5 is moved toward or backward the twisting hook 10. In association with this movement, the second shaft 12 is also moved, so that the arm 5 is inclined to move with respect to the twisting hook 10. As the arm 5 is inclined in this manner, the operating link 16 is swung about the shaft 17. The amount of swing of the operating link 16 is transmitted through the coupling link 15 to the bend guide member 4 to swing the latter 4. That is, the components for adjusting the angle of the bend guide member are so designed that, as the arm 5 and the bend guide member 4 approaches the twisting hook 10, the angle of the bend guide member 4 is increased.

Figure 6:
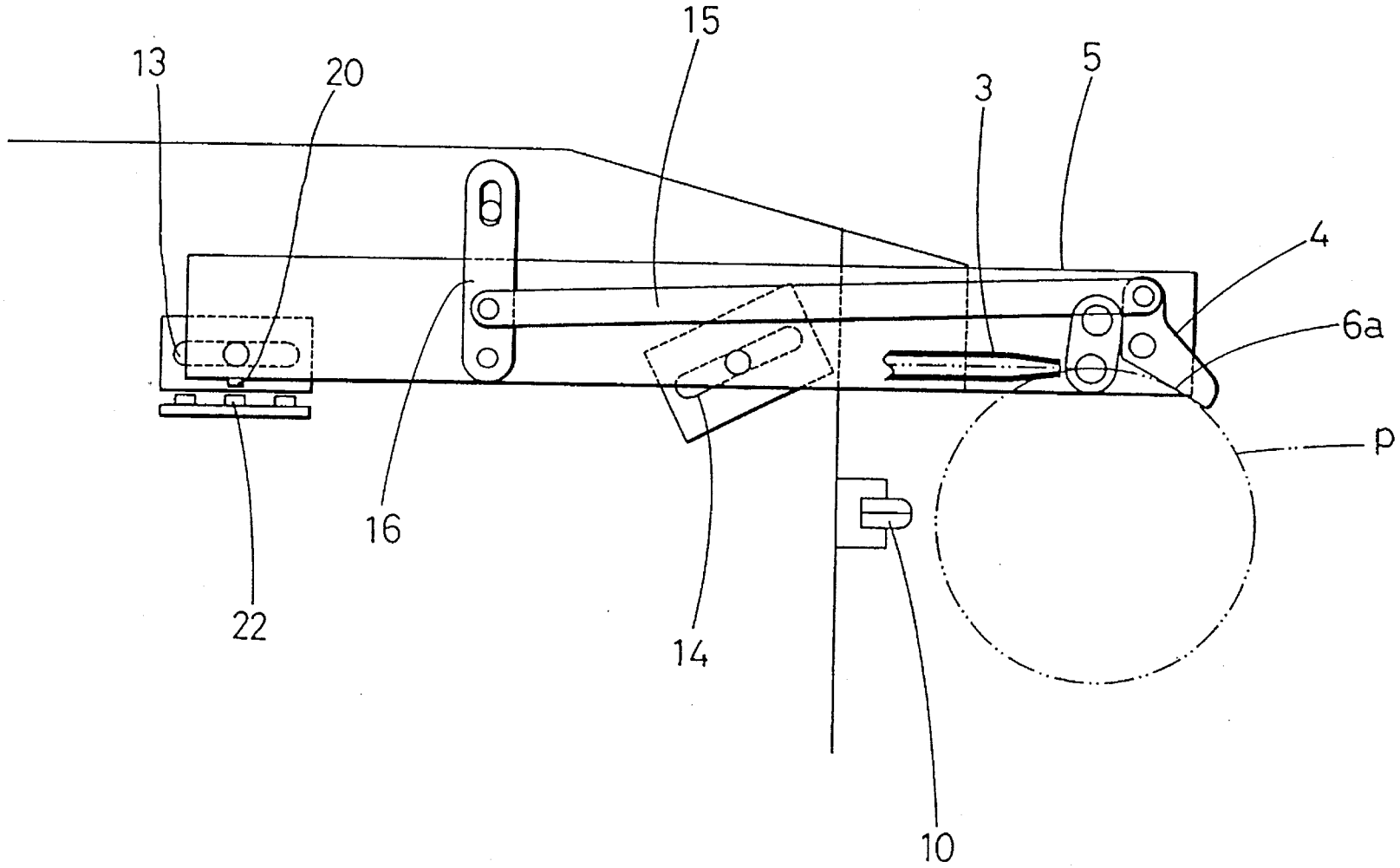
FIGS. 6 and 7 are explanatory diagrams for a description of the operation of the position adjusting mechanism.
Figure 7:
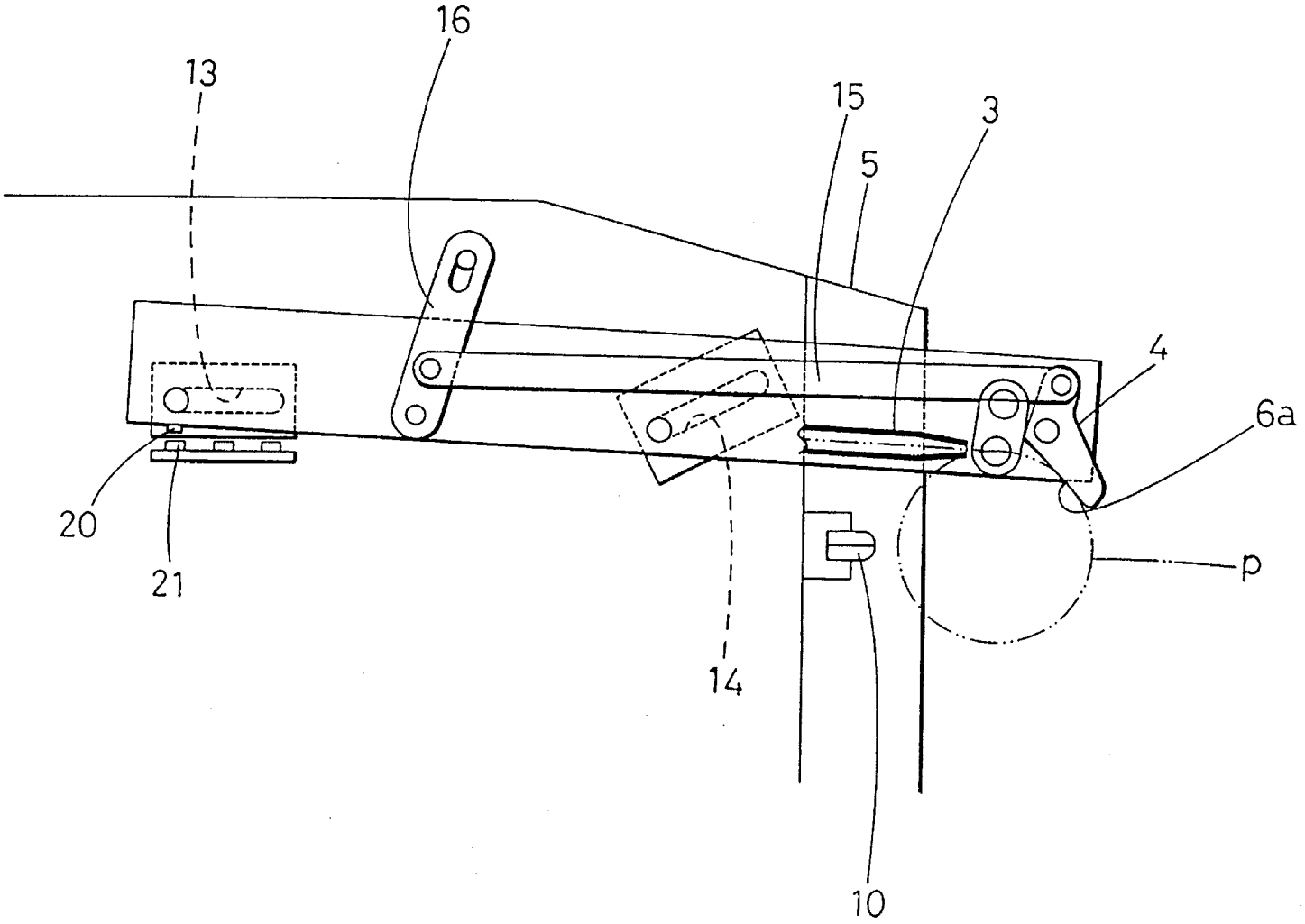

In the case where, as shown in FIG. 5, the arm 5 and the bend guide member 4 are far from the twisting hook 10, the angle of the bend guide member 4 is small, and the diameter of the wire loop p is therefore large. In the case where, as shown in FIG. 6, the arm 5 and the bend guide member 4 approach the twisting hook 10, the angle of the bend guide member 4 is increased, and the diameter of the wire loop p is decreased. In the case where, as shown in FIG. 7, the arm 5 and the bend guide member 4 are set near the twisting hook 10, the angle of the bend guide member 4 is further increased, and the diameter of the wire loop p is further decreased. That is, when the arm 5 and the bend guide member 4 are far from the twisting hook 10, the diameter of the wire loop is large; whereas they are near the twisting hook 10, the diameter of the wire loop is small. Hence, as is apparent from FIGS. 5, 6 and 7, at one and the same position the twisting hook is able to hold the wire loop p independently of the diameter of the wire loop. This means that the twisting hook is able to hold the wire loop satisfactorily at all times.

On the other hand, it is necessary to adjust the amount of feed of the wire 1 according to the diameter of the wire loop. For this purpose, the position of the first shaft 11 at the base end of the arm 5 is detected, and the amount of feed of the wire is adjusted according to the position of the first shaft 11 thus detected. The position of the first shaft 11 is detected as follows: As shown in FIG. 7, a magnet 20 is mounted near the first shaft 11, and a position detecting sensor is provided in parallel with the horizontal guide groove 13 adapted to guide the first shaft 11. The sensor comprises a plurality of Hall elements (three Hall elements 21, 22 and 23 in the embodiment) depending on the number of wire loops different in diameter. The position of the first shaft 11 can be detected from the reaction of each of the Hall elements 21, 22 and 23 to the movement of the magnet 20. The angle of inclination of the bend guide member 4 is determined from the position of the first shaft 11, and the diameter of the wire loop p is determined from the angle of inclination of the bend guide member. In other words, the diameter of the wire loop can be determined from the position of the first shaft 11. Hence, the amount of feed of the wire suitably can be set according to the diameter of the wire loop thus determined; that is, it can be adjusted according to the diameter of the wire loop.

In the above-described embodiment, the amount of swing of the bend guide member 4, and the movement of the arm 5 are adjusted at the same time; however, the guide mechanism may be so modified that they are adjusted separately.

What is claimed is:

1. A bind guide mechanism for a binding machine in which a wire of metal is looped around articles to be bound with the wire and in which a part of the wire thus looped is twisted to bind the articles together, said binding wire guide mechanism comprising:

a wire feeding mechanism for feeding the wire;

a straight guide member for straightly guiding the wire fed by said wire feeding mechanism;

a bend guide member provided at the outlet of said straight guide member, said bend guide member having a wire receiving surface to receive the wire fed out of said straight guide member in such a manner that the wire abuts obliquely against said wire receiving surface;

an angle varying means for varying an angle of abutment which said wire forms with said wire receiving surface; and connecting means operatively connecting the straight guide member with the bend guide member, wherein positions of said straight guide member and said bend guide member are adjustable according to the angle of abutment of the wire with respect to said wire receiving surface.

2. A binding wire guide mechanism as claimed in claim 1, wherein an amount of feed of said wire is adjustable according to an angle of inclination of said bend guide member.

3. A binding wire guide mechanism as claimed in claim 1, wherein an amount of feed of said wire is adjustable according to an angle of inclination of said bend guide member.

4. A binding wire guide mechanism according to claim 1, wherein said wire receiving surface has a flat portion.

5. A binding wire guide mechanism according to claim 1, wherein said wire receiving surface has a curved portion.

6. A binding wire guide mechanism according to claim 1, wherein said connecting includes a link mechanism for simultaneously adjusting the straight guide member and the bend guide member.

* * * * *